United States Patent [19]

Vogt et al.

[11] 4,147,134

[45] Apr. 3, 1979

[54] BOILER HAVING A HOT GAS GENERATOR FOR BURNING LIQUID OR GASEOUS FUELS

[75] Inventors: Alfred Vogt, Schaan; Wolfgang Kunkel, Triesen, both of Fed. Rep. of Germany

[73] Assignee: Interliz Anstalt, Vaduz, Liechtenstein

[21] Appl. No.: 848,563

[22] Filed: Nov. 4, 1977

[30] Foreign Application Priority Data

Nov. 5, 1976 [DE] Fed. Rep. of Germany ..... 2650660

[51] Int. Cl.[2] ..... F22B 9/12; F23J 5/02; F23M 9/00

[52] U.S. Cl. ..... 122/5; 110/205; 122/149; 110/326

[58] Field of Search ..... 110/205, 204, 326; 122/5, 136 R, 136 C, 155 A, 149, 235 R

[56] References Cited

U.S. PATENT DOCUMENTS

| | | | |
|---|---|---|---|
| 3,276,435 | 10/1966 | Cosimo | 122/149 |
| 3,477,411 | 11/1969 | Gething | 122/136 |
| 3,604,400 | 9/1971 | Sharan | 122/235 |
| 3,685,496 | 8/1972 | Stiefel | 122/149 |
| 3,766,891 | 10/1973 | Csathy et al. | 122/149 |

*Primary Examiner*—Kenneth W. Sprague
*Attorney, Agent, or Firm*—Walter Becker

[57] ABSTRACT

A boiler having a hot gas generator for burning liquid or gaseous fuels. The hot gas generator comprises a combustion chamber unit, into the combustion chamber of which the fuel and air for combustion are introduced and in which the combustion of the fuel takes place. The combustion gases are conveyed out of the combustion chamber into a water cooled boiler firebox. A compressor supplies the air for combustion into the combustion chamber unit. A flue gas conduit, which leads to the flue gas vent of the boiler, at its inlet end, which is connected with the boiler firebox, is connected with the air intake of the compressor of the hot gas generator ro recirculating a regulatable amount of flue gases into the combustion chamber unit of the hot gas generator. The flue gas conduit offers a resistance to the flow of flue gas therein, which resistance is greater than the chimney draft force present in the flue gas vent of the boiler.

6 Claims, 3 Drawing Figures

BOILER HAVING A HOT GAS GENERATOR FOR BURNING LIQUID OR GASEOUS FUELS

The present invention relates to a boiler having a hot gas generator for burning liquid or gaseous fuels. The hot gas generator comprises a combustion chamber unit, into the combustion chamber of which the fuel and air for combustion are introduced and in which the combustion of the fuel takes place, and out of the combustion chamber of which the combustion gases are conveyed into a water cooled boiler firebox. The hot gas generator also comprises a compressor for supplying the air for combustion into the combustion chamber unit.

A hot gas generator of the above mentioned type for burning a liquid fuel, such as heating oil, is described for example in German Offenlegungsschrift No. 24,57,963. Hot gas generators are differentiated from normal conventional oil burners, such as those used for operating boilers of central heating units, in that they burn the fuel in a specific combustion chamber which also forms a part of the hot gas generator or the combustion chamber unit thereof and which can be optimally adjusted to the most pyrotechnically advantageous burning conditions and are highly heatable, so that, with the aid of the combustion chamber, shortly after starting the hot gas generator, the air for combustion supplied from the compressor of the hot gas generator can be greatly preheated by heat exchange. With such hot gas generators, a stoichiometric combustion which is practically free of excess air can be carried out in the smallest possible space. Such a burning is already soot-free in the starting phase, and formation of carbon monoxide and unburned hydrocarbons is avoided. A hot gas with a very high temperature can be generated, the heat of which can be utilized with very high efficiency in a subsequent heat exchanger. These hot gas generators would therefore, in themselves, be suitable for a protechnically and economically very advantageous operation of boilers for central heating units in place of conventional oil burners, with which, in most instances, soot forms in the starting phase and leads to fouling of the boiler and impairment of the heat transfer, and with which the formation of carbon monoxide and unburned hydrocarbons also occurs, which lead to increased heating costs and odorous annoyances from the oil burning. However, the operation of a boiler with a hot gas generator also creates problems. The fuel combustion and flame formation in the relatively small combustion chamber of the hot gas generator, with the use of a strong rotating introduction of the air for combustion into the combustion chamber, causes loud flame noises which can be transmitted throughout the boiler, which is operated by the hot gas generator, as far as the chimney. The generation of a rotating air stream of high velocity during the preheating of the air for combustion in the combustion chamber unit of the hot gas generator and during the introduction of the air for combustion into the combustion chamber thereof requires higher compressor pressures and causes undesirable loud air intake noises. A further problem is the undesired great dependency of the combustion in the hot gas generator on the chimney draft, that is, on the upward draft of the chimney, which, with the customary boiler constructions, generally has an effect as far back as the firebox of the boiler and is subject to oscillations and can therefore unfavorably affect the combustion in the hot gas generator. A particular problem consists in that, with the pyrotechnically great advantages of a hot gas generator, such as the completely soot-free condition and highest combustion efficiency and lack of unburned hydrocarbons, is associated the drawback that the nitric oxide content of the flue gases increases due to the very high combustion temperature and high velocities produced in the combustion chamber of the hot gas generator. Nitric oxides are harmful materials, and recent environmental protection regulations attempt to also limit the nitric oxide content in flue gases of oil combustion heating units, and, as a matter of fact, to a maximum value which is considerably less than the nitric oxide content normally resulting with conventional oil burners, which, by the use of an excess of air, that is, by a supply of air for combustion which is greater than the stoichiometric amount, operate at lower flame and combustion temperatures. Such an operation of conventional oil burners with amounts greater than the stoichiometric amounts, would, however, if applied to a hot gas generator, again destroy the advantage of the latter, which consists in the practically stoichiometric combustion with little waste for achieving the highest possible combustion gas temperatures, which are particularly favorable for the transmission of the gas heat to the boiler heating surfaces and to the boiler water and for the economical utilization of fuel energy.

It is therefore an object of the present invention to produce a boiler which is operated and combined with a hot gas generator and with which the above mentioned problems, namely the nitric oxide in the flue gases, the sensitivity of the hot gas generator to chimney draft oscillations, and the flame as well as the air intake noises, can be solved.

This object and other objects and advantages of the present invention will appear more clearly from the following specifications in connection with the accompanying drawings, in which.

Figure 1:
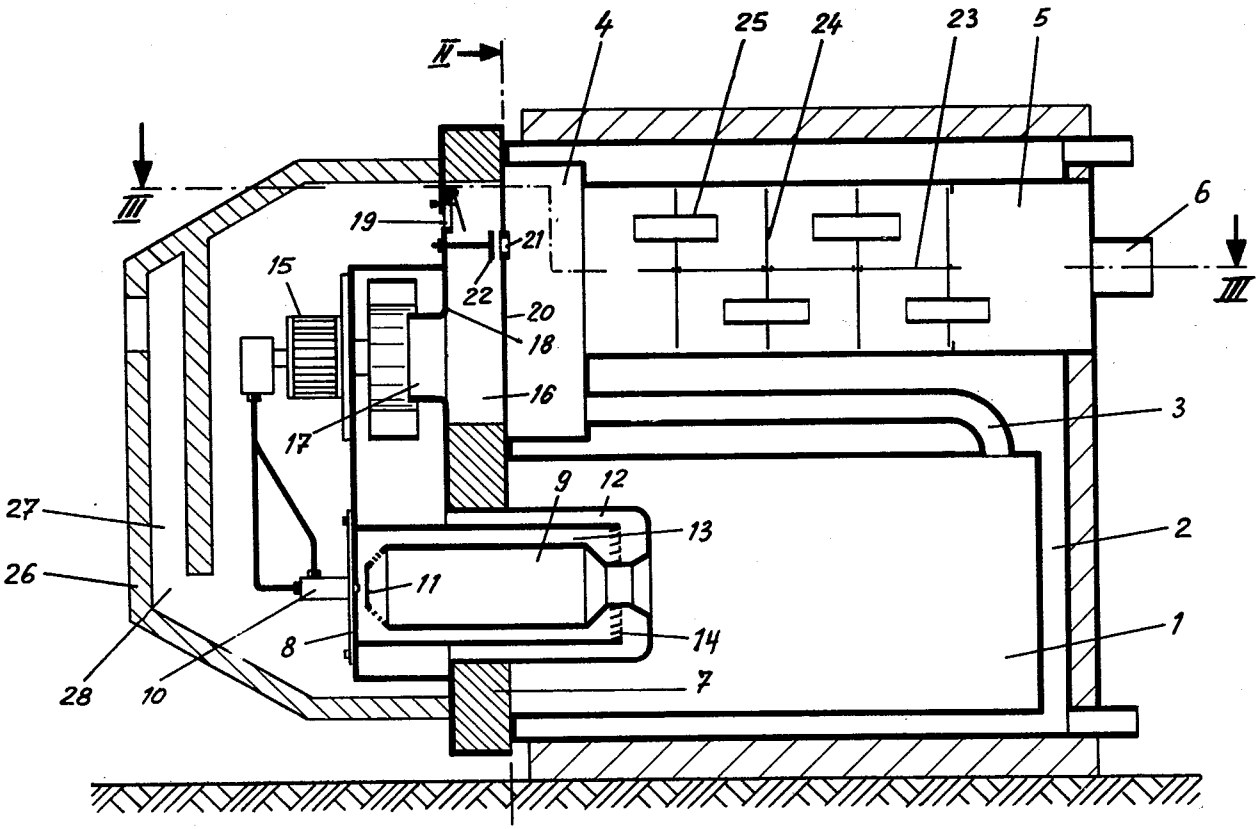
FIG. 1 is a vertical longitudinal section of the novel boiler with a hot gas generator.
Figure 2:
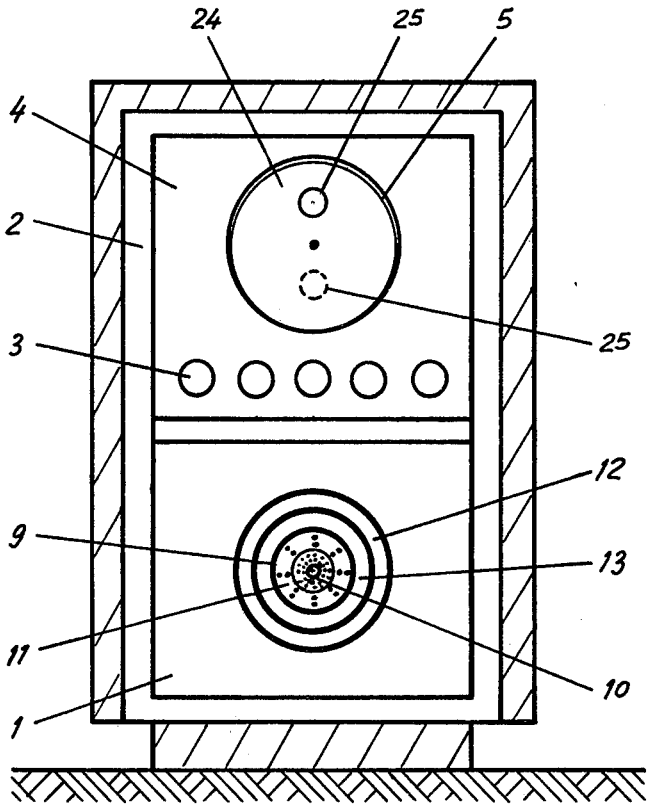
FIG. 2 is a cross section taken along the line II—II of FIG. 1.
Figure 3:
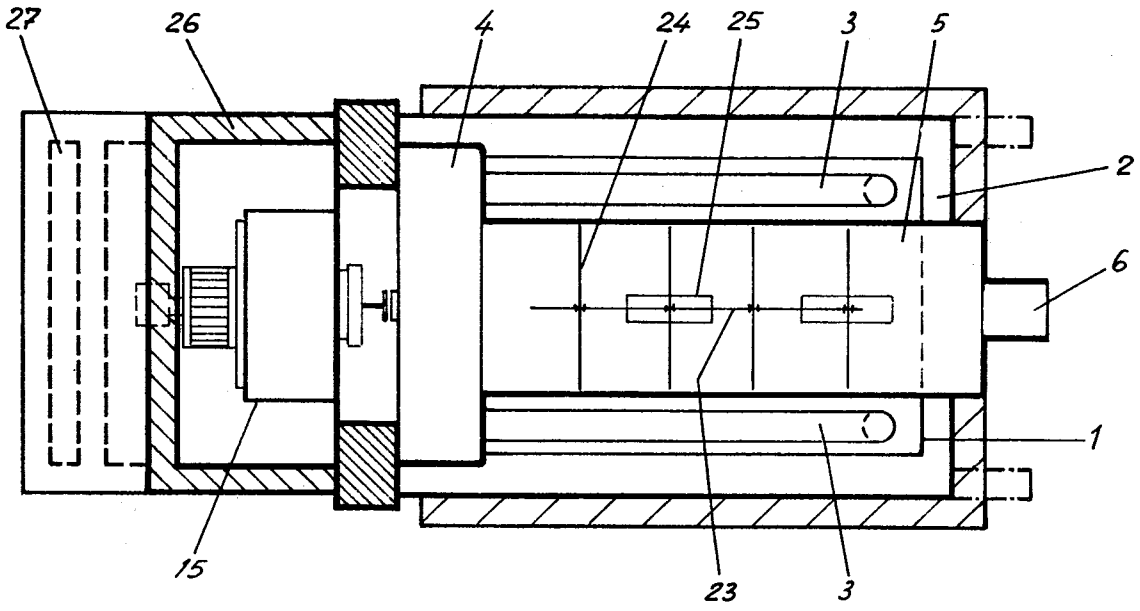
FIG. 3 is a horizontal section taken along the line III—III of FIG. 1.

The boiler pursuant to the present invention is characterized primarily in that a flue gas conduit, which forms the last heating flue of the boiler and which leads to the flue gas vent of the boiler, at its inlet end which is connected with the boiler firebox, is connected with the air intake opening of the compressor of the hot gas generator for recirculating a regulatable amount of flue gases into the combustion chamber unit of the hot gas generator. The boiler of the present invention is further characterized in that the flue gas conduit is designed with a resistance to the flow of flue gas therein, which resistance is greater than the chimney draft force operating in the flue gas vent of the boiler. This makes it possible to withdraw a partial stream of the already cooled off flue gases from the compressor of the hot gas generator, and, together with the air for combustion, to resupply this partial stream to the combustion chamber unit of the hot gas generator. As a result, while maintaining the combustion practically free of excess air, the formation of nitric oxides in the flames is nearly eliminated. With a proportion of recirculated flue gases to air for combustion of approximately 1:7 to 1:5, the nitric oxide content in the flue gases can be reduced from about 250 ppm (parts per million), the normal value for conventional oil burners, to a value of about 50 ppm, which is below the future maximum allowed values. With the recirculation of the flue gas partial stream ahead of the flue gas conduit, which forms the last heating flue of the boiler and which is designed with a resistance to flow which exceeds the chimney draft which normally occurs, the following is achieved: chimney draft oscillations which occur do not affect the amount of recirculating gas and, as a result, the amount of flue gas drawn off is independent of the chimney draft, so that a constant amount of recirculating flue gas is guaranteed, and, as a result, the combustion in the combustion chamber unit of the hot gas generator also remains stable with regard to the nitric oxide content. At the same time, disadvantageous effects of chimney draft oscillations directly upon the hot gas generator combustion chamber are avoided.

An advantageous embodiment, pursuant to a further feature of the present invention, consists in that the air inlet of the compressor of the hot gas generator is connected with a reversing chamber at the forward end of the boiler. The reversing chamber is connected by a heating flue of the boiler with the closed rear end of the boiler firebox. A flue gas conduit, which further leads to the flue gas vent of the boiler, is connected to the reversing chamber and is designed as a muffling chamber having a muffling insert which produces a resistance to the stream flow. This embodiment has the advantage, which is significant for the flue gas recirculation, that the flue gases which leave the boiler firebox first flow through the water cooled heating flue, so that the flue gases, prior to the recirculation of a partial stream of flue gas, have already been considerably cooled off, whereby the effect of the nitric oxide avoidance is aided by the flue gas recirculation. The formation of the flue gas conduit as a roomy muffling chamber with a muffling insert has the advantage that transmission of flame noises into the flue gas vent of the boiler and into the chimney connected thereto is suppressed. In this connection, the muffling insert simultaneously produces a resistance to the stream flow, which resistance exceeds the normally occurring chimney draft, so that chimney draft oscillations cannot be transmitted back through the wide muffling chamber into the reversing chamber. The heating flue can advantageously comprise a plurality of round pipes having a relatively small cross section. Simple round turbulator inserts can then be inserted into these round pipes from the direction of the reversing chamber. With these turbulator inserts, the resistance to the stream flow in this heating flue, which forms the second heating flue of the boiler, and thereby the flue gas temperature of the flue gases exiting from the boiler, can be regulated over a wide range in order to adjust the flue gas temperature in conformity with that minimum temperature which can be tolerated under the respective chimney conditions. The flue gas conduit advantageously comprises a single correspondingly wide pipe which makes possible the convenient installation of a specific muffling insert. The muffling insert advantageously comprises a plurality of plates which are spaced from one another in the direction of flow of the flue gases. The plates essentially fill out the open transverse space of the flue gas conduit or the pipe which forms the flue gas conduit. The plates have passages, preferably in the form of pipe sections, which are offset in alternating fashion from one side to the other along the longitudinal axis of the flue gas conduit. With large boiler units, more than one pipe, for example two pipes, can be provided as the flue gas conduit. The flue gas conduit is preferably designed as a round cylinder with a corresponding round muffling insert for muffling the interfering frequencies which occur. Such round construction has proven more favorable than a pipe having an angular cross section.

An advantageous embodiment of the present invention consists in that the compressor of the hot gas generator is arranged on a boiler door which closes off the reversing chamber. The boiler door is double walled in the region of the reversing chamber, and the air intake of the compressor empties into the hollow space of the boiler door. The outer wall of the boiler door has an air intake which leads into the hollow space, and the inner wall has a recirculation opening which connects the hollow space with the reversing chamber and which has an adjustable closure element. In this way the boiler door can close off the boiler firebox while at the same time forming the burner base plate on which the compressor of the hot gas generator can be arranged directly ahead of the reversing chamber and in spaced relationship thereto, and on which the combustion chamber unit can be arranged ahead of the boiler firebox. The boiler door forms, with the hollow construction of that part thereof which closes off the reversing chamber, an air intake and mixing compartment which, in a particularly simple and expedient structural manner, ahead of the air intake of the compressor, combines the air intake path (which is regulatable by a throttle flap on the air intake opening) and the flue gas recirculation path (which is regulatable by means of the adjustable closure element located on the recirculation opening). Moreover, this hollow construction has the advantage that that portion of the boiler door which closes off the reversing chamber is cooled by the cool fresh air which flows through the hollow space and is thereby insulated toward the outside. In this manner, a special thermal insulation of this part of the boiler door, for example with ceramic materials, is needless.

Pursuant to a further feature of the present invention, a sound absorbing hood which covers the combustion chamber unit and the compressor of the hot gas generator is arranged on the forward end of the boiler. The sound absorbing hood forms an oblong hood inner chamber with the forward end of the boiler. The compressor lies at one end of the hood inner chamber, and the combustion chamber unit lies at the other end thereof. The air intake of the sound absorbing hood is designed as a sound proofing air conduit, the discharge opening of which to the hood inner space is arranged at that end of the oblong hood inner chamber at which the combustion chamber unit of the hot gas generator is located. With this construction, disturbing air intake noises of the hot gas generator are muffled by the sound absorbing hood and are appreciably suppressed. In this connection, the air conduit of the sound absorbing hood eliminates a direct transmission of sound vibrations through the air intake of the sound absorbing hood toward the outside. The air flowing into the hood inner chamber flows through the oblong hood inner chamber prior to entering the intake of the compressor, in this manner cooling those components of the hot gas generator, for example the compressor motor, oil pump, and burner nozzle assembly, which are located in the hood inner chamber.

Referring now to the drawings in detail, the boiler comprises a boiler firebox 1 which is surrounded by a boiler water chamber 2 and forms a first water cooled heating flue of the boiler. A heating flue or conduit 3 in the form of a plurality of round pipes leads from the closed rear end of the boiler firebox 1, as a second water cooled heating flue of the boiler, to a common reversing chamber 4 at the forward end of the boiler. A flue gas conduit 5 formed from a single round cylinder leads from the reversing chamber 4, as a third water cooled heating flue of the boiler, to a flue gas vent 6 located at the rear end of the boiler. The boiler firebox 1 and the reversing chamber 4 are closed off at the forward end of the boiler by a boiler door 7 which simultaneously serves as a burner assembly base or mounting plate for a hot gas generator. The hot gas generator comprises a combustion chamber unit 8, which contains a combustion chamber 9 which forms a part of the hot gas generator. The combustion chamber unit 8 empties into the boiler firebox 1 through the boiler door 7. By means of a nozzle arrangement 10, a liquid fuel, for example, is introduced into the combustion chamber 9, in which the complete fuel combustion takes place and out of which the combustion gases are conveyed into the boiler firebox 1. In addition, air for combustion is conveyed into the combustion chamber 9 through a twist generating, perforated diaphragm 11 located on the nozzle end of the combustion chamber. The air for combustion beforehand flows through two concentric, annular, cylindrical air passages 12 and 13. In the inner air passage 13, the air is considerably preheated by heat exchange with the combustion chamber cylinder. In this connection, the twist vanes 14 bring about a spiral air stream in the inner air passage 13. The air for combustion is supplied by means of a compressor 15 of the hot gas generator. The compressor 15 is arranged separately next to the combustion chamber unit 8 on the boiler door 7, namely ahead of the reversing chamber 4. The boiler door 7, in the region of the reversing chamber 4, is double walled. The air intake 17 of the compressor 15 empties into the thus formed hollow space 16. The outer wall 18 of the double walled boiler door 7 comprises an air inlet 19 which leads into the hollow space 16 and is provided with an air flap. The inner wall 20 comprises a recirculation opening 21 which connects the hollow space 16 with the reversing chamber 4 and has an adjustable closure element 22. A portion of the flue gases, which are cooled off prior to entering the reversing chamber 4 by flowing through the heating flue 3, are withdrawn from the reversing chamber 4 through the recirculation opening 21 by the compressor 15 and, together with drawn-in air for combustion, are re-supplied to the combustion chamber unit 8. By means of this flue gas recirculation into the flame formed in the combustion chamber 9 of the combustion chamber unit 8, the nitric oxide formation is largely eliminated and the nitric oxide content of the flue gases leaving the boiler is lowered to a great extent.

The flue gas conduit 5 lies between the recirculation opening 21 at the reversing chamber 4 and the flue gas vent 6 of the boiler, so that the amount of gas recirculated is removed from the flue gas stream ahead of the last heating flue of the boiler. The flue gas conduit 5 is designed in such a way that it has a resistance to the flow of flue gas which is greater than the chimney draft force normally encountered in practice in the flue gas vent 6. As a result, oscillations of the chimney underpressure are not transmitted back to the reversing chamber 4, and the amount of gas recirculated and drawn in by the compressor of the hot gas generator is independent of the oscillations of the chimney draft force, so that constant amounts of the flue gas can be resupplied to the combustion chamber unit 8 of the hot gas generator, and, with regard to nitric oxide formation, a combustion which is low in harmful materials can be guarenteed in the combustion chamber unit 8. The desired resistance to flow of the flue gas conduit 5 can be brought about by an insert therein, which insert produces throttle areas for the stream of flue gas. In the flue gas conduit 5, which has a large volume and thereby is designed as a muffling chamber, is arranged a muffling insert 23 which, according to a special embodiment, comprises a plurality of plates 24 which, in the direction of flow of the flue gases, are spaced from one another. The plates 24 essentially fill in the open transverse space of the flue gas conduit 5 and have passages in the form of pipe sections 25 which are offset in alternating fashion or sequence from one side to the other along the longitudinal axis of the flue gas conduit 5. This muffling insert 23 produces a resistance to the flow of the flue gases, which resistance exceeds the chimney draft. In addition, the muffling insert 23, with its chambers which are located between the individual plates 24, effects a muffling of the noise of the burning in the boiler and prevents a transmission of the burning noises into the flue gas vent 6 and into the chimney connected thereto.

On the front end of the boiler, which is formed by the boiler door 7, is arranged the sound absorbing hood 26 which covers the compressor 15 and the combustion chamber unit 8 of the hot gas generator. The sound absorbing hood 26, with the front side of the boiler, forms an oblong hood inner chamber in the vertical direction (FIG. 1). The compressor 15 lies at one end of the hood inner chamber, and the combustion chamber unit 8 lies at the other end thereof. The air intake of the sound absorbing hood 26 is designed as air conduit 27, the discharge opening 28 of which to the hood inner space lies at that end of the oblong hood inner chamber at which the combustion unit 8 of the hot gas generator is located. The sound absorbing hood 26 covers the hot gas generator in such a way that disturbing air intake noises are eliminated toward the outside, in which connection the air conduit 27 is sound proof and a direct transmission of air intake noises through the air intake opening of the sound absorbing hood is prevented. Moreover, the air conduit 27 conveys the air to a place within the hood inner chamber from which the air must flow through the oblong hood inner chamber up to the air inlet 19. In so doing, the still cool air for combustion flows past the combustion unit 8 and the compressor 15 of the hot gas generator, so that essentially the burner nozzle assembly 10, the motor of the compressor, as well as the oil pump driven by the motor, are cooled.

It is, of course, to be understood that the present invention is by no means limited to the specific showing of the drawings, but also encompasses any modifications within the scope of the appended claims.

What we claim is:

1. A boiler having a hot gas generator for burning liquid and gaseous fuels, which comprises:

a combustion chamber unit provided with a combustion chamber for receiving fuel and air for combustion and containing the combustion;

a compressor associated with said boiler for supplying the air for combustion into said combustion chamber unit, said compressor having an air intake;

a water cooled firebox associated with said boiler for receiving combustion gases from said combustion chamber;

a flue gas conduit, one end of which is connected to said firebox for receiving combustion gases therefrom, and also to said compressor air intake for recirculating a regulatable amount of combustion gases back into said combustion chamber unit;

a flue gas vent connected to the other end of said flue gas conduit; and means located in said flue gas conduit for providing a resistance to flow of combustion gases therein, said resistance being greater than the draft force in said flue gas vent.

2. A boiler according to claim 1, which includes a heating flue interposed between said firebox and said flue gas conduit for effecting the connection therebetween; and a reversing chamber communicating with said compressor air intake, said heating flue, and said flue gas conduit, said means in said flue gas conduit for providing a resistance to flow of combustion gases being a muffling insert.

3. A boiler according to claim 2, in which said muffling insert comprises a plurality of plates spaced from one another in the direction of flow of the combustion gases, said plates extending substantially over the entire inner diameter of said flue gas conduit, and being provided with passages therethrough offset from one plate to the next on alternating sides of the axis of said flue gas conduit.

4. A boiler according to claim 3, in which said passages are in the form of pipe sections.

5. A boiler according to claim 2, which includes a boiler door which closes off said reversing chamber and is double walled in the region thereof so as to form a hollow space, said compressor air intake communicating with said hollow space, the outermost of said double walls most remote from said reversing chamber being provided with an air inlet adapted to communicate with atmospheric air for receiving same, the innermost of said double walls being provided with a recirculation opening for connecting said hollow space with said reversing chamber for receiving combustion gases therefrom, an adjustable closure element being associated with said boiler door for regulating the flow of combustion gases through said recirculation opening.

6. A boiler according to claim 1, in which a sound absorbing hood covers said compressor and said combustion chamber unit at that end of said boiler which is remote from said flue gas vent in such a way as to form an oblong hood inner chamber, at one end of which is located said combustion chamber unit, at the other end of which is located said compressor, the air intake of which is adapted to communicate with said hood inner chamber, said hood being provided with an air inlet in the form of a sound proofing air conduit, said air conduit having an opening in the vicinity of said combustion chamber unit for supplying air into said hood inner chamber.

* * * * *